US010907437B2

(12) United States Patent
Deng et al.

(10) Patent No.: US 10,907,437 B2
(45) Date of Patent: Feb. 2, 2021

(54) MULTI-LAYER BACKUP RING

(71) Applicants: Guijun Deng, The Woodlands, TX (US); John K. Wakefield, Cypress, TX (US); Christopher Cook, Houston, TX (US); Frank J. Maenza, Houston, TX (US)

(72) Inventors: Guijun Deng, The Woodlands, TX (US); John K. Wakefield, Cypress, TX (US); Christopher Cook, Houston, TX (US); Frank J. Maenza, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/367,341

(22) Filed: Mar. 28, 2019

(65) Prior Publication Data

US 2020/0308920 A1 Oct. 1, 2020

(51) Int. Cl.

| | |
|---|---|
| ***E21B 33/12*** | (2006.01) |
| ***E21B 23/06*** | (2006.01) |
| ***E21B 33/128*** | (2006.01) |
| ***E21B 33/129*** | (2006.01) |

(52) U.S. Cl.

CPC ..... *E21B 33/1216* (2013.01); *E21B 23/06* (2013.01); *E21B 33/128* (2013.01); *E21B 33/1292* (2013.01); *E21B 33/1293* (2013.01); *E21B 33/1208* (2013.01)

(58) Field of Classification Search

CPC ..... E21B 23/01; E21B 23/06; E21B 33/12; E21B 33/1216

See application file for complete search history.

(56) References Cited

U.S. PATENT DOCUMENTS

| | | | |
|---|---|---|---|
| 2,726,722 | A | 12/1955 | Baker |
| 2,767,795 | A | 10/1956 | Bush |
| 2,797,759 | A | 7/1957 | Long et al. |
| 2,885,009 | A | 5/1959 | Baker |
| 2,921,633 | A | 1/1960 | Baker |
| 2,945,541 | A | 7/1960 | Maly et al. |
| 3,229,767 | A | 1/1966 | Carter |

(Continued)

FOREIGN PATENT DOCUMENTS

| | | | |
|---|---|---|---|
| AU | 2015397127 | B2 | 12/2016 |
| EP | 1197632 | A2 | 4/2002 |

(Continued)

OTHER PUBLICATIONS

Notification of Transmittal of the International Search Report and the Written Opinion of the International Searching Authority, or the Declaration; PCT/US2020/019872; dated Jun. 19, 2020; 13 pages.

(Continued)

*Primary Examiner* — Tara Schimpf

(74) *Attorney, Agent, or Firm* — Cantor Colburn LLP

(57) ABSTRACT

A backup including a radially inwardly disposed circumferentially continuous ring; a radially outwardly disposed circumferentially discontinuous ring, the circumferentially discontinuous ring comprising a plurality of segments arranged to overlap adjacent ones thereof about a circumference of the circumferentially discontinuous ring.

18 Claims, 6 Drawing Sheets

(56) References Cited

U.S. PATENT DOCUMENTS 3,298,440 A 1/1967 Current
3,313,553 A 4/1967 Gastineau
3,343,607 A 9/1967 Current
3,358,766 A 12/1967 Current
3,381,969 A 5/1968 Crow et al.
3,385,679 A 5/1968 Current
3,481,611 A 12/1969 Stratton
3,517,742 A 6/1970 Williams
3,960,311 A 6/1976 Griffiths
4,204,690 A 5/1980 Holland et al.
4,349,204 A 9/1982 Malone
RE31,933 E 7/1985 Taylor et al.
4,665,978 A 5/1987 Luke
4,753,444 A 6/1988 Jackson et al.
4,765,404 A 8/1988 Bailey et al.
4,852,394 A 8/1989 Lazes
4,892,144 A 1/1990 Coone
4,910,832 A 3/1990 Schaub et al.
5,027,894 A 7/1991 Coone et al.
5,161,806 A 11/1992 Balsells
5,311,938 A 5/1994 Hendrickson et al.
5,678,635 A * 10/1997 Dunlap ..... E21B 23/01 166/123
6,318,482 B1 11/2001 Fidtje
6,431,274 B1 7/2002 Tedham et al.
6,513,600 B2 2/2003 Ross
6,581,682 B1 6/2003 Parent et al.
6,598,672 B2 7/2003 Bell et al.
6,769,491 B2 * 8/2004 Zimmerman ..... E21B 33/1204 166/138
7,124,826 B2 10/2006 Simpson
7,178,601 B2 2/2007 Burge
7,273,110 B2 9/2007 Pedersen et al.
7,306,034 B2 12/2007 Garcia
7,341,110 B2 3/2008 Doane et al.
7,665,516 B2 2/2010 Roberts et al.
7,708,080 B2 5/2010 Conaway et al.
7,780,399 B1 8/2010 Garrison
8,151,873 B1 4/2012 Lee et al.
8,151,894 B2 4/2012 Nutley et al.
8,205,671 B1 6/2012 Branton
8,276,678 B2 10/2012 Burnett et al.
8,327,929 B2 12/2012 Reid et al.
8,403,036 B2 3/2013 Neer et al.
8,469,088 B2 6/2013 Shkurti et al.
8,479,809 B2 7/2013 Farquhar
8,662,161 B2 3/2014 Lee et al.
8,701,787 B2 4/2014 Shkurti et al.
8,839,874 B2 9/2014 Bishop et al.
9,140,094 B2 9/2015 Lee et al.
9,194,206 B2 11/2015 Xu et al.
9,260,936 B1 2/2016 Branton
9,587,458 B2 3/2017 Derby
9,845,658 B1 12/2017 Nish et al.
10,087,704 B2 10/2018 Conner et al.
10,435,972 B2 10/2019 Crump et al.
2002/0043368 A1 4/2002 Bell et al.
2003/0037932 A1 3/2003 Guillory et al.
2003/0226659 A1 12/2003 Smith et al.
2004/0134659 A1 7/2004 Hoffman et al.
2004/0150165 A1 8/2004 Grondahl et al.
2005/0189103 A1 9/2005 Roberts et al.
2006/0289173 A1 12/2006 Conaway et al.
2007/0125532 A1 6/2007 Murray et al.
2007/0200299 A1 8/2007 Kunz
2007/0256827 A1 11/2007 Guerrero et al.
2007/0261863 A1 11/2007 MacLeod et al.
2008/0041583 A1 2/2008 Angman et al.
2008/0060821 A1 3/2008 Smith et al.
2008/0061510 A1 3/2008 Li et al.
2008/0135240 A1 6/2008 Brennan et al.
2008/0190600 A1 8/2008 Shkurti et al.
2009/0065191 A1 3/2009 Reid et al.
2009/0159265 A1 6/2009 Freyer
2009/0255690 A1 10/2009 Conner et al.
2009/0277648 A1 11/2009 Nutley et al.
2009/0283254 A1 11/2009 Andersen et al.
2009/0308592 A1 12/2009 Mercer et al.
2010/0038074 A1 2/2010 Patel
2010/0186970 A1 7/2010 Burnett
2010/0276137 A1 11/2010 Nutley et al.
2010/0294485 A1 11/2010 Lynde et al.
2011/0037229 A1 2/2011 Clarke
2011/0101615 A1 5/2011 Clarke
2011/0297368 A1 12/2011 Lembcke
2012/0018143 A1 1/2012 Lembcke
2012/0037355 A1 2/2012 Bishop et al.
2012/0073830 A1 3/2012 Lembcke et al.
2012/0133098 A1 5/2012 Farquhar
2012/0145412 A1 6/2012 Andersen et al.
2012/0217025 A1 8/2012 Shkurti et al.
2012/0305236 A1 12/2012 Gouthaman
2013/0147120 A1 6/2013 O'Malley
2013/0213672 A1 8/2013 Nutley et al.
2013/0306330 A1 11/2013 Bishop et al.
2013/0306331 A1 11/2013 Bishop et al.
2014/0034335 A1 2/2014 Nutley et al.
2014/0262351 A1 9/2014 Derby
2014/0265161 A1 9/2014 Sutterfield et al.
2014/0290946 A1 10/2014 Nguyen et al.
2015/0101796 A1 4/2015 Davies et al.
2015/0115539 A1 4/2015 Guenther et al.
2015/0308214 A1 10/2015 Bilansky et al.
2015/0330174 A1 11/2015 Craigon et al.
2015/0354313 A1 12/2015 McClinton et al.
2016/0109025 A1 4/2016 McCarrey et al.
2016/0208632 A1 7/2016 Davis et al.
2016/0369586 A1 12/2016 Morehead et al.
2016/0376869 A1 12/2016 Rochen et al.
2017/0191340 A1 7/2017 Dent et al.
2017/0342797 A1 11/2017 Murphree et al.
2018/0010418 A1 1/2018 Vanlue
2018/0023366 A1 1/2018 Deng et al.
2018/0106125 A1 4/2018 Deng et al.
2018/0298716 A1 10/2018 Cayson et al.
2018/0298718 A1 10/2018 Cayson et al.
2018/0320473 A1 11/2018 Xu et al.
2019/0017347 A1 1/2019 Kendall et al.
2019/0040710 A1 2/2019 Deng et al.
2019/0078413 A1 3/2019 Kendall et al.
2019/0120011 A1 * 4/2019 Kellner ..... E21B 33/128
2019/0169951 A1 6/2019 Frazier
2019/0249511 A1 8/2019 Deng et al.
2019/0345791 A1 11/2019 Kendall et al.
2019/0352997 A1 11/2019 Brown
2019/0368304 A1 12/2019 Deng et al.

FOREIGN PATENT DOCUMENTS

WO 2006046075 A2 5/2006
WO 2006121340 A1 11/2006
WO 2009074785 A2 6/2009
WO 2013128222 A1 9/2013

OTHER PUBLICATIONS

Notification of Transmittal of the International Search Report; PCT/US2018/050395; dated Jan. 2, 2019; 5 pages.

Notification of Transmittal of the International Search Report and the Written Opinion of the International Searching Authority, or the Declaration; PCT/US2018/027359; dated Aug. 1, 2018; 11 pages.

Notification of Transmittal of the International Search Report and the Written Opinion of the International Searching Authority, or the Declaration; PCT/US2018/041880; dated Nov. 21, 2018; 13 pages.

* cited by examiner

MULTI-LAYER BACKUP RING

BACKGROUND

Backup configurations have been known in the downhole industry for a long time. They function in various ways to reduce the tendency of rubber or similar sealing materials extruding when exposed to a pressure differential thereacross. Generally backup rings attempt to fulfill their purposes by getting in the way of an extrusion path of the seal material. Some are successful though many are not and most are expensive and difficult to set with marginal pressure holding capacities. The art therefore would be receptive to alternative backups that provide commercial advantages.

SUMMARY

A backup including a radially inwardly disposed circumferentially continuous ring; a radially outwardly disposed circumferentially discontinuous ring, the circumferentially discontinuous ring comprising a plurality of segments arranged to overlap adjacent ones thereof about a circumference of the circumferentially discontinuous ring.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
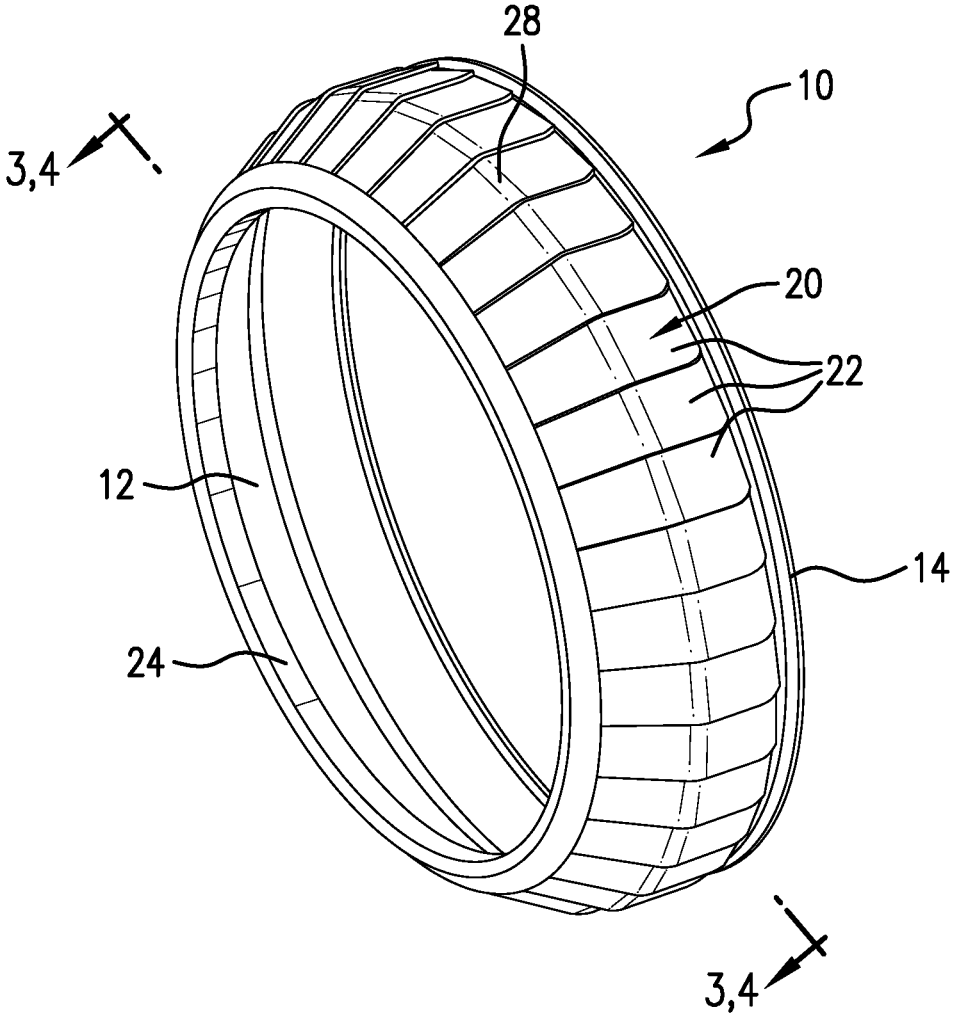
FIG. 1 is an isometric view of a backup as disclosed herein.

Referring to FIG. 1, an isometric view of a backup 10 is illustrated. The backup 10 is of a type that is used in the downhole industry to prevent extrusion of a sealing material when subjected to a pressure differential across the sealing material. Configurations of this type are known to the industry as for example packer systems, plugs, etc. The backup 10 is to be placed in use near one end of a sealing element (discussed further in relation to FIGS. 6 and 7 below). The backup 10 itself is unique in that it provides for an unusually low setting force, ultra-expansion; super conformability settability in out of round conditions such as ovaled tubulars or open hole that is not cylindrical, etc. By "unusually low setting force" it is meant that setting force required is in a range of about 15 kips to about 30 kips and that where common systems would require multiple or large area pistons to achieve the setting of the tool, the backup as disclosed herein should not. Further, the backup as disclosed herein will reduce tool length and size. The term "ultra-expansion" is intended to mean expansion ratio (Casing ID/Gage ring OD) is more than 115%. The term "super-conformability" is intended to mean the ring can easily conform to not only casing/Borehole ID with defects such as a groove, a cut, etc., but also an oval borehole/casing ID with less setting force.

Benefits of the backup ring 10 are achieved due to its construction. The backup 10 comprises a radially inwardly disposed circumferentially continuous ring 12 that is composed of a thin material. The material may be a metal or a plastic, for example. "Thin" meaning having a thickness of from about 0.015" to about 0.050" thick. The thickness allows for great conformability. The ring 12 exhibits no breaks therein such that it presents a complete barrier to extrusion. Moreover, the ring 12 includes, in at least some embodiments, a flare feature 14 that ensures a complete contact connection with the tubular form (casing, tubular, open hole, etc.) in which the backup 10 is set. The flare feature 14 energizes a connection with the wall at edge 16 thereby rendering extrusion of the seal material therepast extremely unlikely. In addition, because of the shape of the flare 14 as shown, the seal material itself will tend to further energize the contact of edge 16 with the wall.

Figure 2:
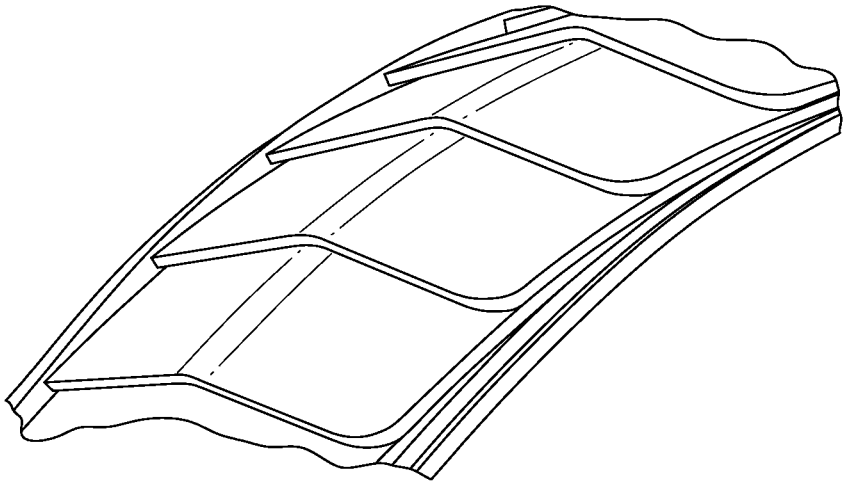
FIG. 2 is a larger view of a portion of the backup of FIG. 1 illustrating the overlapping segments.
Figure 3:
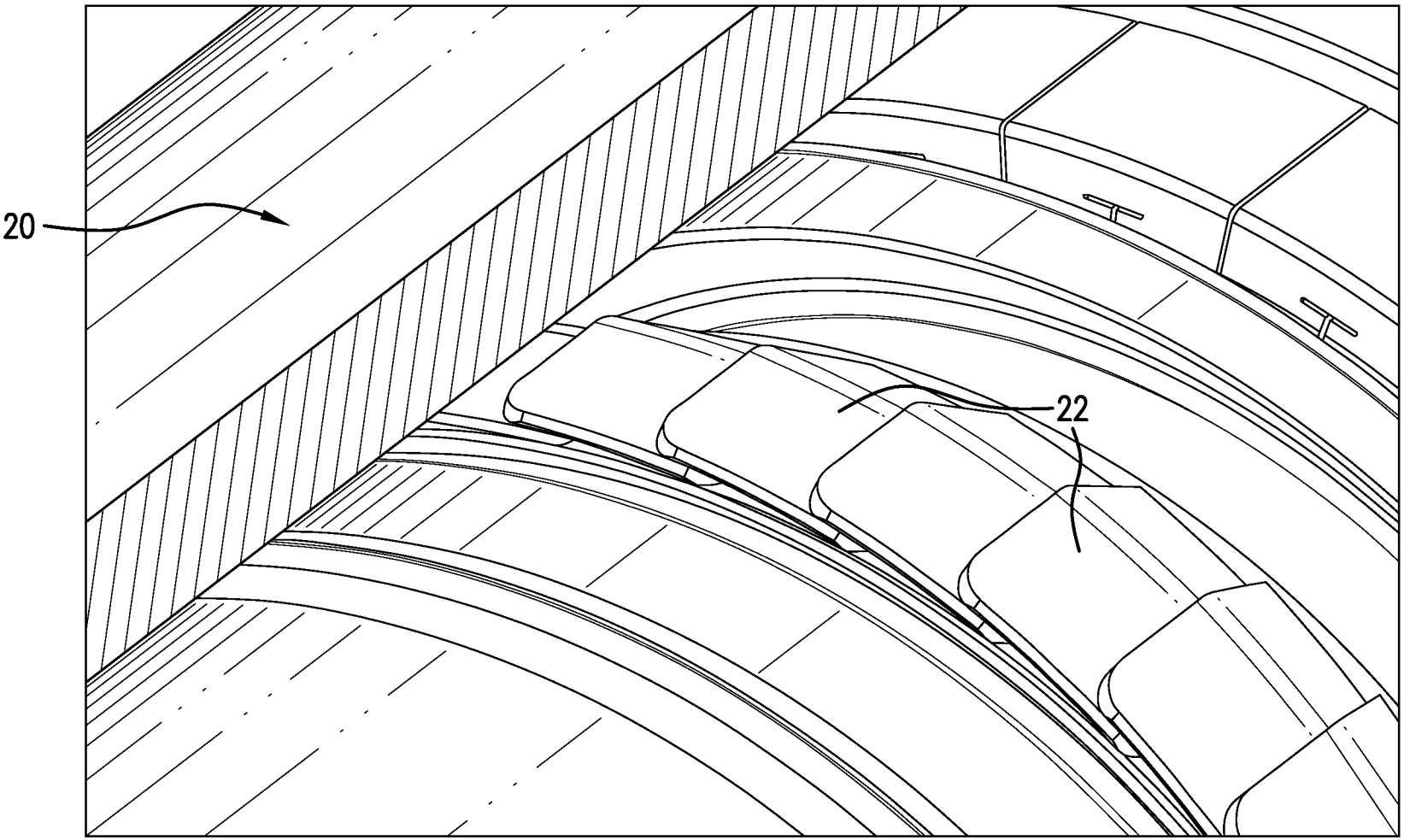
FIG. 3 is a cross sectional view of FIG. 1 illustrating the overlapping nature of the segments before setting of a tool using the backup.
Figure 4:
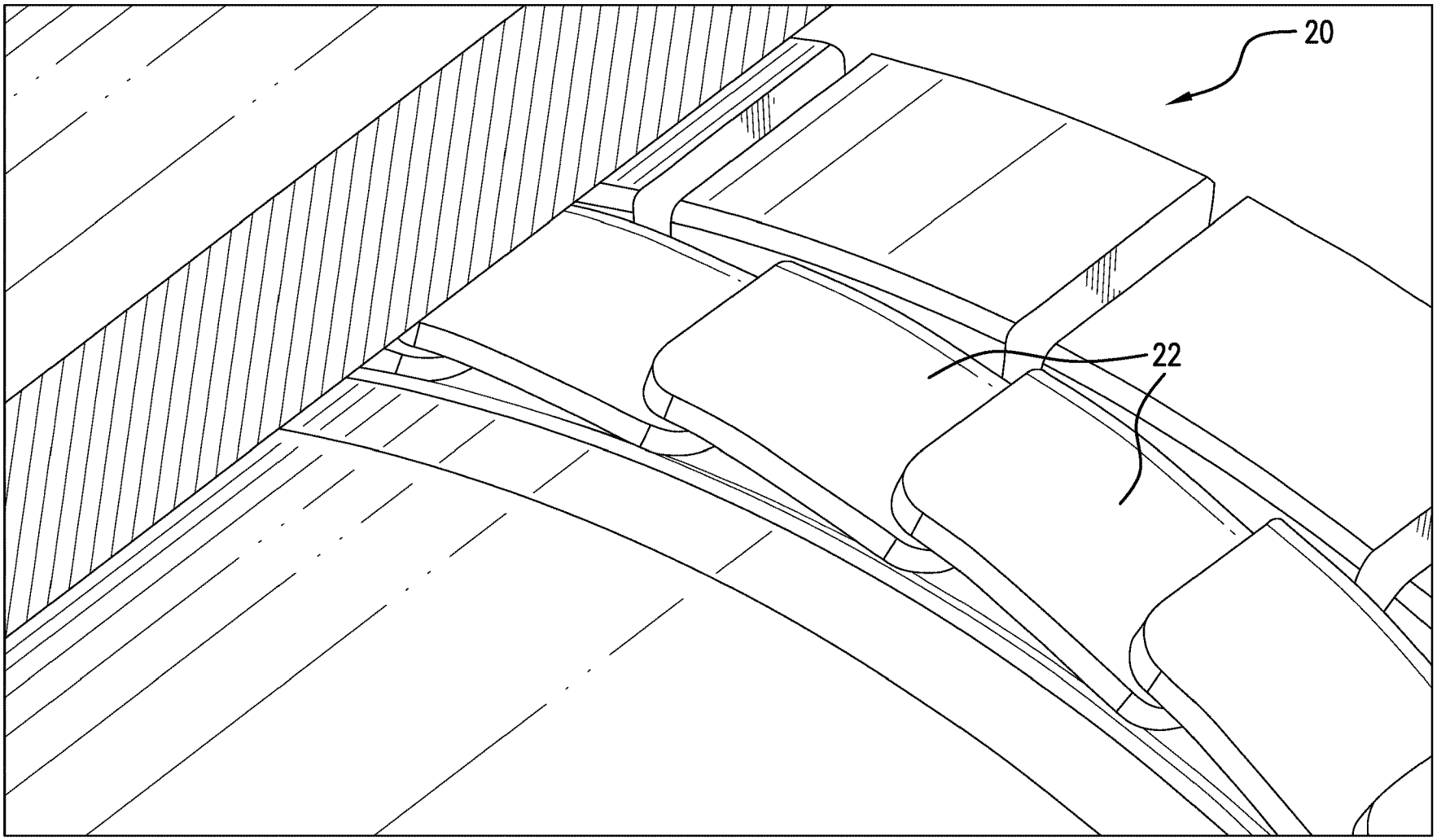
FIG. 4 is a cross sectional view of FIG. 1 illustrating the overlapping nature of the segments after setting of a tool using the backup.

The backup 10 also comprises a radially outwardly disposed circumferentially discontinuous ring 20. The ring 20 comprises a plurality of segments 22 arranged to overlap adjacent ones thereof about a circumference of the circumferentially discontinuous ring. Each of the segments 22 extend from a base ring 24 that both joins each of the segments 22 together but also joins the ring 12 with the ring 20. Beyond the base ring 24, each segment 22 is completely detached from any other segment beyond mere contact therewith. This is to say that the individual segments are essentially free from one another other than for base ring 24. Such construction eliminates hoop stress in the ring 20 during expansion in setting of the tool using this backup 10 thereby reducing the force required to set the tool that uses backup 10. Referring to FIG. 2, the overlapping nature of the segments 22 is more easily perceived. In an embodiment, illustrated in FIGS. 3 and 4 at least one of the segments 22 overlaps the adjacent segment 22 by 10% to 50% of the width of the segment 22 (that dimension being taken in the circumferential direction) in an unset condition. In the subsequent set condition, the overlap, in an embodiment is about 20% of what it was in the unset position. In each case, there will remain overlap among the segments 22 in the set position so that the plurality of segments 22 provide for support of the ring 12 in the expanded set position.

Also in embodiments, the segments 22 includes a bend 28 therein in the axial direction of the backup 10. As used herein, the term "bend" is meant to encompass a macro curvilinear shape that wholly or partially makes up the ring or ring segment geometry. By macro curvilinear shape it is meant that the deviation in direction of the material of the segments can range from a slight curvature on the order of only a few degrees (up to a much large degree as noted below) of deviation and a curving area of deviation to a more pronounced bend where a line is visible by the human eye and/or can be felt by the human hand is formed at the deviation point (rather than an area where no actual line can be seen or felt). The bend 28 further strengthens the segments 22 and hence the ring 20 without impacting the benefits of reduced setting force, ultra-expansion and super-conformability. Bends 28 in some embodiments employ an angle of from about 100 degrees to about 170 degrees.

In another embodiment, the bend 28 may not actually be a bend but rather simply a variation in the thickness of the segment at the same location. Variations in thickness of the material making up the segment 22 will affect its conformability. Lesser thicknesses will allow greater conformability which greater thicknesses will provide relatively more resistance to conformability.

In particular embodiments the degree of overlap of the segments 22 may be selected to address swab off and or radial support. Specifically, the larger the overlap, the greater the resistance to swab off under higher flow conditions prior to setting of the tool.

Figure 5:
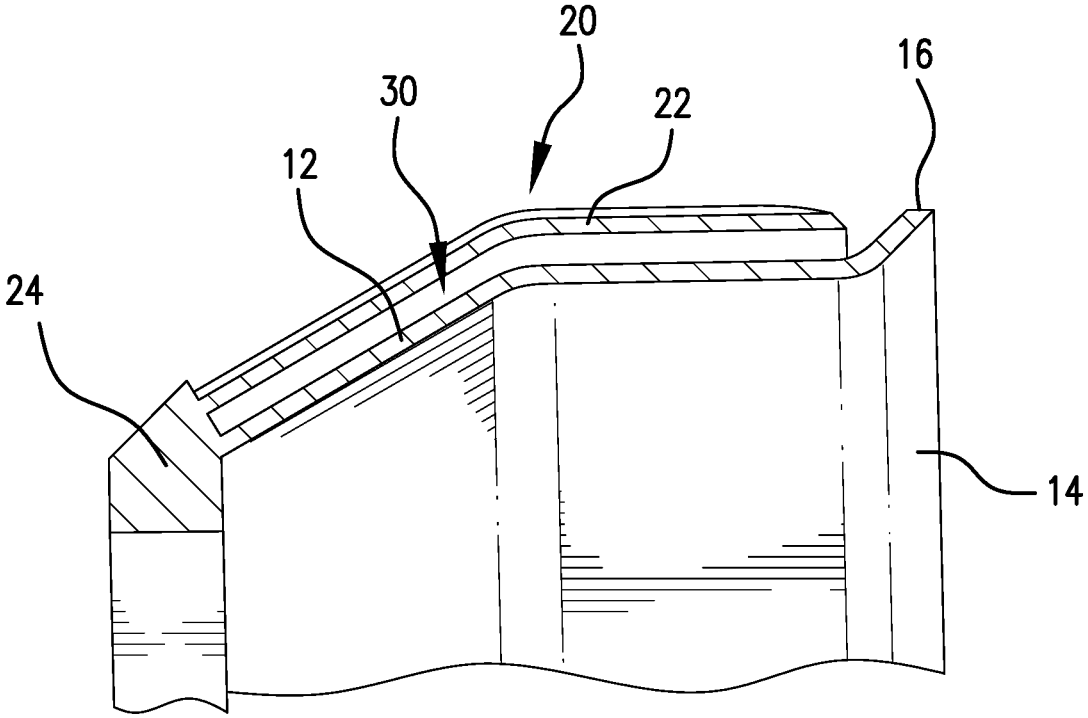
FIG. 5 is an enlarged illustration of a portion of the backup of FIG. 1 illustrating various features of the backup.

Referring to FIG. 5, it should be noted that there is a gap 30 between the ring 12 and the ring 20 that is about 0.005" to about 0.050" thick. The gap 30 provides the benefit of facilitating segment expansion by providing space to avoid contact friction at early stages of expansion. In embodiments, the gap is of uniform thickness around the backup. In other embodiments, the gap is of non-uniform thickness about the backup.

Figure 6:
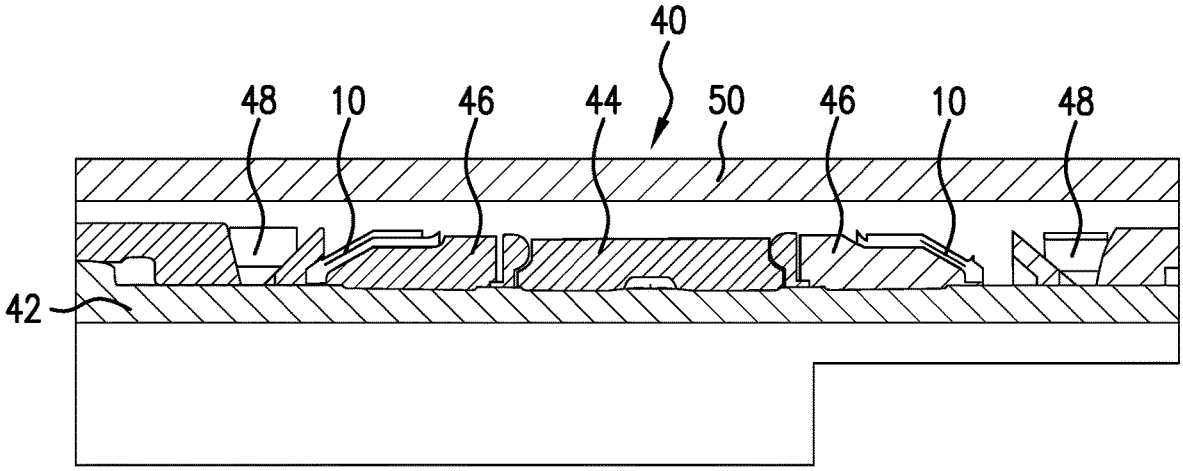
FIG. 6 is a cross sectional view of a tool employing the backup disclosed herein in an unset position.
Figure 7:
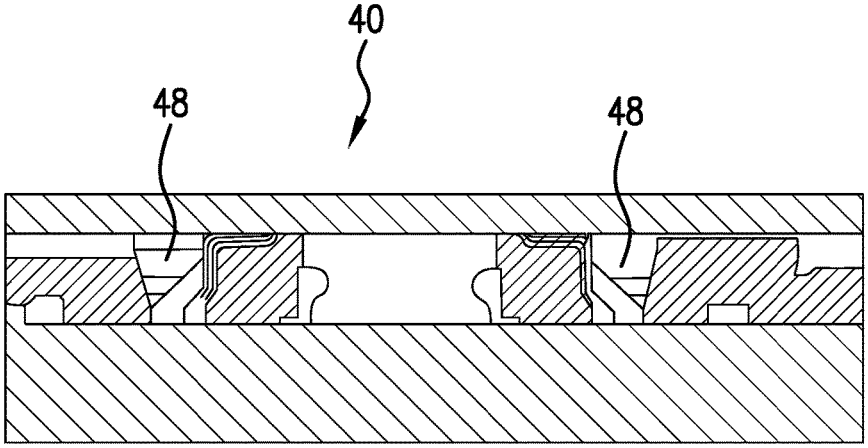
FIG. 7 is a cross sectional view of the tool of FIG. 6 in a set position.

Turning now to FIGS. 6 and 7, one embodiment of a tool 40 that employs the backup 10 as disclosed is illustrated. The tool 40 is illustrated in cross section in both an unset and a set position, in FIGS. 6 and 7, respectively. Referring to FIG. 6, the unset tool 40 includes a mandrel 42, upon which is mounted a primary seal 44 and secondary seals 46. The secondary seals 46 are directly backup up by backups 10, one on each longitudinal end of the tool 40. Also present are expandable backups 48. Upon setting of the tool 40, the components noted are forced to move toward one another effectively shortening the overall length of the tool 40 in order to seal the tool 40 against a casing or other tubular structure 50. As will be appreciated from a perusal of FIGS. 6 and 7, the backups 10 are forced to move radially outwardly into contact with the casing 50 making sealing contact therewith to prevent extrusion of the seals 44 or 46 past the backups 10.

Finally, in an embodiment, the backup 10 is an additively manufactured component. Additive manufacturing allows for much simpler manufacture of the backup as shown and described than conventional machining and so reduces cost of manufacture.

Figure 8:
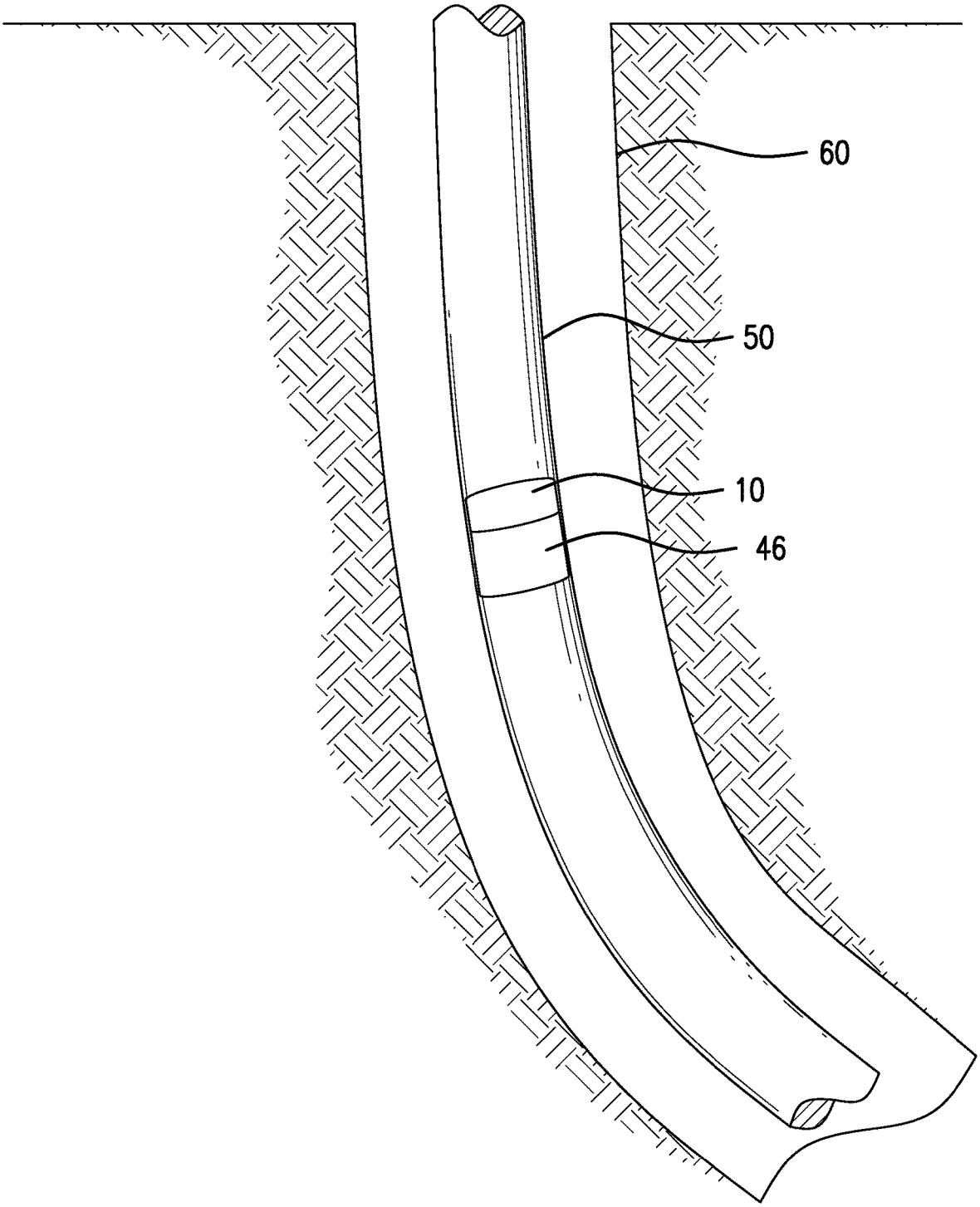
FIG. 8 is a schematic representation of a downhole system employing a backup as described herein.

Referring to FIG. 8, a schematic representation of a downhole system 60 including a tubing or casing string 50 and a backup 10 disposed adjacent a seal 46 therein.

Set forth below are some embodiments of the foregoing disclosure:

Embodiment 1

A backup including a radially inwardly disposed circumferentially continuous ring; a radially outwardly disposed circumferentially discontinuous ring, the circumferentially discontinuous ring comprising a plurality of segments arranged to overlap adjacent ones thereof about a circumference of the circumferentially discontinuous ring.

Embodiment 2

The backup as in any prior embodiment wherein the radially inwardly disposed ring and the radially outwardly disposed ring are joined at an axial end of the backup.

Embodiment 3

The backup as in any prior embodiment wherein segments of the discontinuous ring or rings overlap the adjacent segments.

Embodiment 4

The backup as in any prior embodiment wherein in a set position, the segments of the discontinuous ring or rings continue to overlap the adjacent segments.

Embodiment 5

The backup as in any prior embodiment wherein the plurality of segments are connected to each other only at the axial end of the backup.

Embodiment 6

The backup as in any prior embodiment wherein one or more of the plurality of segments include a bend.

Embodiment 7

The backup as in any prior embodiment wherein one or more of the plurality of segments include a variation in thickness of the one or more segments.

Embodiment 8

The backup as in any prior embodiment wherein the bend is duplicated in each of the plurality of segments.

Embodiment 9

The backup as in any prior embodiment consisting of no more rings than the radially inwardly disposed ring and the radially outwardly disposed ring.

Embodiment 10

The backup as in any prior embodiment wherein the radially inwardly disposed ring is of a uniform thickness.

Embodiment 11

The backup as in any prior embodiment wherein the radially inwardly disposed ring is of a non-uniform thickness.

Embodiment 12

The backup as in any prior embodiment wherein the radially inwardly disposed ring further includes a flare feature.

Embodiment 13

The backup as in any prior embodiment wherein the radially inwardly disposed ring and the radially outwardly disposed ring are spaced from each other by a circumferential gap.

Embodiment 14

The backup as in any prior embodiment wherein the gap is uniform between the rings.

Embodiment 15

The backup as in any prior embodiment wherein the gap is non-uniform between the rings.

Embodiment 16

A tool including a seal, a backup as in any prior embodiment adjacent thereto.

Embodiment 17

A downhole system including a string disposed in a borehole, a backup as in any prior embodiment operably connected to the string.

Embodiment 18

The downhole system as in any prior embodiment further comprising a seal in operative contact with the backup.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The term "about" is intended to include the degree of error associated with measurement of the particular quantity based upon the equipment available at the time of filing the application. For example, "about" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A backup comprising:

a base ring defining a longitudinal axis;

a radially inwardly disposed circumferentially continuous ring extending in a generally axial direction from the base ring;

a radially outwardly disposed circumferentially discontinuous ring extending in a generally axial direction from the base ring similar to the continuous ring and segments of the discontinuous ring radially overlap the continuous ring, the circumferentially discontinuous ring comprising a plurality of segments arranged to overlap adjacent ones thereof about a circumference of the circumferentially discontinuous ring.

2. The backup as claimed in claim 1 wherein the radially inwardly disposed ring and the radially outwardly disposed ring are joined at an axial end of the backup.

3. The backup as claimed in claim 2 wherein the plurality of segments are connected to each other only at the base ring.

4. The backup as claimed in claim 1 wherein segments of the discontinuous ring overlap the adjacent segments by 10%.

5. The backup as claimed in claim 1 wherein in a set position, the segments of the discontinuous ring continue to overlap the adjacent segments.

6. The backup as claimed in claim 1 wherein one or more of the plurality of segments include a bend.

7. The backup as claimed in claim 6 wherein the bend is duplicated in each of the plurality of segments.

8. The backup as claimed in claim 1 wherein one or more of the plurality of segments include a variation in thickness of the one or more segments.

9. The backup as claimed in claim 1 consisting of no more rings than the radially inwardly disposed ring and the radially outwardly disposed ring extending from the base ring.

10. The backup as claimed in claim 1 wherein the radially inwardly disposed ring is of a uniform thickness.

11. The backup as claimed in claim 1 wherein the radially inwardly disposed ring is of a non-uniform thickness.

12. The backup as claimed in claim 1 wherein the radially inwardly disposed ring further includes a flare feature.

13. The backup as claimed in claim 1 wherein the radially inwardly disposed ring and the radially outwardly disposed ring are spaced from each other by a circumferential gap.

14. The backup as claimed in claim 13 wherein the gap is uniform between the rings.

15. The backup as claimed in claim 13 wherein the gap is non-uniform between the rings.

16. A tool comprising:

a seal;

the backup as claimed in claim 1 adjacent thereto.

17. A downhole system comprising:

a string disposed in a borehole;

the backup as claimed in claim 1 operably connected to the string.

18. The downhole system as claimed in claim 17 further comprising a seal in operative contact with the backup.

* * * * *